US010730737B2

(12) United States Patent
Heindl

(10) Patent No.: US 10,730,737 B2
(45) Date of Patent: Aug. 4, 2020

(54) TAP SYSTEM

(71) Applicant: Peter A. Heindl, Riederberg (AT)

(72) Inventor: Peter A. Heindl, Riederberg (AT)

( * ) Notice: Subject to any disclaimer, the term of this patent is extended or adjusted under 35 U.S.C. 154(b) by 22 days.

(21) Appl. No.: 16/082,978

(22) PCT Filed: Mar. 15, 2017

(86) PCT No.: PCT/EP2017/056082
§ 371 (c)(1),
(2) Date: Sep. 7, 2018

(87) PCT Pub. No.: WO2017/162496
PCT Pub. Date: Sep. 28, 2017

(65) Prior Publication Data

US 2019/0077649 A1 Mar. 14, 2019

(30) Foreign Application Priority Data

Mar. 23, 2016 (AT) ..... 154/2016

(51) Int. Cl.
*B67D 1/12* (2006.01)
*B67D 1/04* (2006.01)
*B67D 1/08* (2006.01)
*B67D 1/07* (2006.01)

(52) U.S. Cl.
CPC ..... *B67D 1/1272* (2013.01); *B67D 1/0406* (2013.01); *B67D 1/07* (2013.01); *B67D 1/0894* (2013.01); *B67D 1/127* (2013.01); *B67D 2210/00068* (2013.01)

(58) Field of Classification Search
CPC ..... B67D 1/1272; B67D 1/127; B67D 2210/00068; B67C 2003/2694
USPC ..... 141/269, 101–102, 279, 284
See application file for complete search history.

(56) References Cited

U.S. PATENT DOCUMENTS

| | | | | |
|---|---|---|---|---|
| 2,063,228 | A | 12/1936 | Robert | |
| 6,360,788 | B1 * | 3/2002 | Saurin | B08B 15/023 141/85 |
| 8,701,720 | B2 * | 4/2014 | Adriansens | B65B 55/027 141/85 |
| 8,899,281 | B2 | 12/2014 | Russell | |
| 9,162,864 | B1 * | 10/2015 | Wickramasinghe | A47G 33/002 |
| 2012/0018030 | A1 * | 1/2012 | Laumer | B67C 3/001 141/1 |
| 2017/0190559 | A1 | 7/2017 | Koller et al. | |

FOREIGN PATENT DOCUMENTS

| | | | |
|---|---|---|---|
| AT | 56309 | B | 11/1912 |
| CH | 528440 | A | 9/1972 |
| DE | 8914890 | U1 | 2/1990 |

(Continued)

*Primary Examiner* — Timothy P. Kelly
(74) *Attorney, Agent, or Firm* — Smartpat PLC

(57) ABSTRACT

The invention relates to a tap system comprising a container (3), in which at least one filler line (14) for introducing a carbonated beverage leads to at least one drinking vessel (7) arranged inside the container, wherein a regulated positive pressure is generated inside the container (3) during the filling of the at least one drinking vessel (7). The pressure filling of the container (3) allows the atmospheric surroundings of the drinking vessel (7) to be placed under pressure instead of placing the drinking vessel (7) itself under pressure.

17 Claims, 1 Drawing Sheet

(56) References Cited

FOREIGN PATENT DOCUMENTS

| | | | |
|---|---|---|---|
| WO | 9842612 | A2 | 10/1998 |
| WO | 9842613 | A2 | 10/1998 |
| WO | 2012123768 | A1 | 9/2012 |
| WO | 2015117173 | A1 | 8/2015 |

* cited by examiner

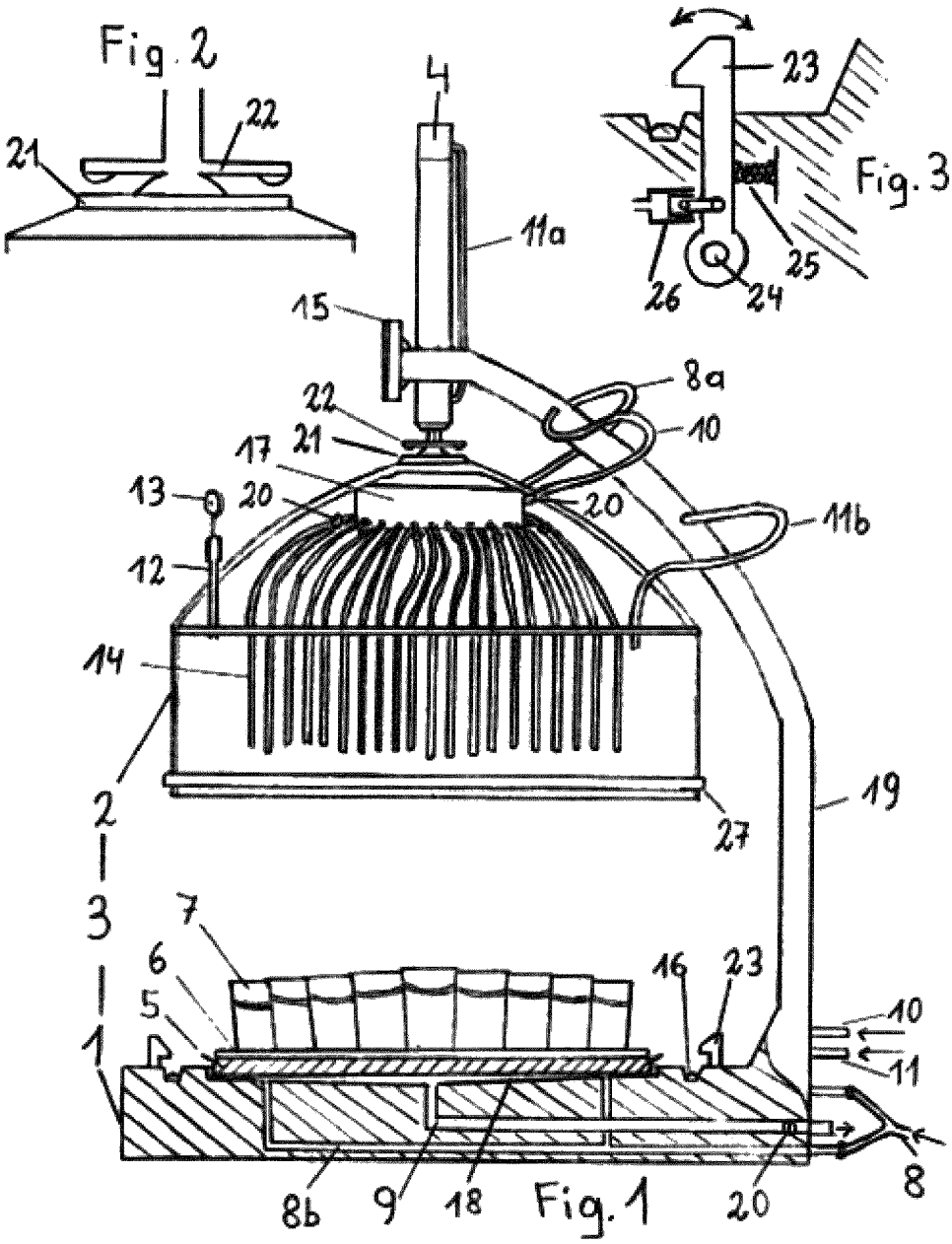
Fig. 2
21
22
4
11a
15
22
21
17
13
20
20
12
14
2
3
1
7
6
5
8a
10
11b
19
27
16
23
10
11
8
8b
9
18
20
Fig. 1
23
Fig. 3
26
24
25
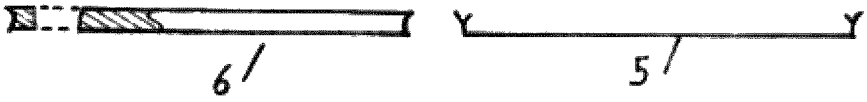
6
5

TAP SYSTEM

TECHNICAL FIELD

The present disclosure relates to a tap system having a container in which at least one filling line for introducing a carbonated beverage leads to at least one drinking vessel arranged inside the container.

BACKGROUND

A longstanding problem of supplying large crowds with freshly tapped drinks is that the foaming (due to the carbon dioxide released under normal pressure during the tapping process) prevents a rapid filling of drinking vessels. Therefore, it is necessary to either tap very slowly until the drinking vessel is full, or in two or more stages, during which the drinking vessel is put away, before it can be refilled after a "foam reduction phase". So far, the tapping frequency therefore depends mainly on how many people serve how many taps.

Several approaches for addressing this problem are known. Specially designed cups are filled through the bottom by means of the so-called "bottom up" filling method (U.S. Pat. No. 8,899,281 B2). The great inadequacy of this tapping method is precisely this circumstance, the exclusive function with these cups. The most probable greatest disadvantage from among those disadvantages which result from the use of otherwise uncommon drinking vessels is that the relatively expensive cups in the throw-away mode either make the drink more expensive or reduce the profit. Furthermore, deposit systems require extra time and effort from the restaurateur as well as the guest, which can be very unpleasant for both parties, especially in high-frequency catering.

Another approach consists in the use of dispensing machines (e.g., WO 2015117173 A1), the capacity of which, however, is only a limited match with the needs of high-frequency catering. Special designs having conveyor belts that have enormous capacities are known, but by design are very elaborate, large and expensive and thus are unsuitable even for high-frequency catering.

What is common to the above solutions is that they do not solve the actual problem of low filling speed associated with the filling of drinking vessels at an awkward oblique angle, but only deal with increasing numbers of tapping devices.

AT 56309 B further discloses a portable beer pressure apparatus for tapping beer in glasses and filling bottles under counter-pressure in which only the bottles (individually) are filled in the conventional counter-pressure method (direct closure of the vessel by plugging), the glasses (single) are tapped by a tap as normal.

SUMMARY

The present invention is therefore based on the object of providing a tap system which eliminates the aforementioned problems and which is suitable to tap carbonated drinks faster and easier in a more efficient, cost-effective and technically easily implementable manner. This is accomplished by introducing the beverage into the drinking vessel above its saturation pressure, i.e., the beverage is introduced into the drinking vessel in a pressurized environment above the atmospheric pressure at which $CO_2$ is released from the beverage. After a pressure equalization, a regulated residual foam formation takes place, which also leads to a higher quality of the tapped drink, because no $CO_2$ escapes from the carbonated beverage in the air due to excessive foam formation.

The preceding object is achieved by a system which includes a container and a plurality of filling lines arranged within the container. The filling lines lead from an equalization tank to a plurality of drinking vessels. A carbonated beverage is introduced through the plurality of filling lines into the plurality of drinking vessels while the container is pressurized. The container may include a container upper part and a container lower part, at least one which is connected to a lifting/lowering mechanism.

The present disclosure is based on the recognition that rapid pressure filling can be achieved in open drinking vessels. This is contrary to known methods of pressurizing bottles or the like by closing them and then introducing gas through the closure, thereby pressurizing the inside of the bottle. Here, instead, not only the drinking vessels (e.g., glasses, cups, pitchers) themselves, but also their atmospheric environment is pressurized.

A tap system of the type mentioned is therefore characterized in that a regulated overpressure is generated within the container during the filling of the at least one drinking vessel. Thus, the carbonated beverage is exposed to normal pressure only after the tapping process is already completed.

This process is designed similarly to the counter-pressure filling of bottles, only in contrast, the overpressure is generated not only in the vessel, but also in its environment. This pressure can also be set significantly higher if necessary, because no pressure difference exists between the inner and outer wall of the container (drinking vessels) to be filled. Since the carbonated beverage hereafter no longer has to flow diagonally along a wall of the drinking vessel due to the then solved foam formation problem, many more drinking vessels can be accommodated next to each other in the preferred vertical tapping than in the conventional tapping process.

The container preferably comprises at least one container upper part and at least one container lower part, wherein either the at least one container upper part or the at least one container lower part are equipped with a lifting/lowering mechanism, by means of which the container parts can be placed on each other.

The change of the full for newly empty drinking vessels can be designed in a preferred embodiment of the invention efficiently via a type of magazine. But because each additional handling step in high-frequency catering leads to a loss of time and work, the magazine should also be designed as a serving tray. That way the drinking vessels neither need to be superfluously placed onto a magazine nor removed from it after the tapping, only to be rearranged on a serving tray. A magazine with preferably about ten to twenty empty drinking vessels would be used in the tap system in this preferred embodiment and removed directly after the tapping process. This can be done without additional handling of the tap system and drinks can immediately be brought to guests.

BRIEF DESCRIPTION OF THE DRAWINGS

Other objects, features, advantages and application options of the disclosed tap system will become apparent from the following description of an embodiment with reference to the drawings.

FIG. 1 is a side view of a tap system in a preferred embodiment.

FIG. 2 is a detailed view of a lower and an upper contact element as in FIG. 1.

FIG. 3 is a detailed view of a snap lock for producing a durable, reversible closure of the container.

DETAILED DESCRIPTION

As shown in FIG. 1, the tap system preferably comprises a serving tray 5 specially designed for this purpose having inner retaining brim, into which a drinking vessel holder 6 is inserted. This drinking vessel holder 6 is preferably made of light but firm material, e.g. a rigid foam. The drinking vessel holder 6 holds the drinking vessels 7 in place during the tapping process as well as during serving.

The drinking vessel holder 6 is advantageously designed in several embodiments, matched to different types of drinking vessels 7 (cups, glasses, pitchers). It is simply pressed into the serving tray 5 having inner retaining brim, whereby it is unshiftably connected to the serving tray 5.

The serving tray 5 and drinking vessel holder 6 additionally each have respective corresponding shape features, which guarantee the orientation of the holder 6 relative to the serving tray 5. This can be, for example, a nub with associated gap or even the shape of the two parts 5, 6 themselves, so ultimately most easily a fitting positive/negative shape feature.

The tray 5 with the drinking vessel holder 6 is equipped with drinking vessels 7 and inserted into a recess 18 designated for it on the container lower part 1 of the tap system. Again, serving tray 5 and recess 18 have a feature that guarantees their orientation to each other, in the easiest case a fitting positive/negative shape.

To operate the tap system, the operator preferably actuates at least one—preferably two-handed operable control element of an electronic control unit 15, which is mounted aloft on the frame 19. The fact that both hands must be used for the start of the tapping process guarantees that a hand is not exposed to a risk of injury during the subsequent tapping process.

The control unit 15 now activates the compressed air flow from a commercial compressor, which can be located somewhere away from the system (cellar, adjoining room, etc.). To generate the regulated overpressure, a gas supply via at least one supply line 11*b* is preferably provided on the container 3.

The compressed air also flows through a supply line 11 to the lifting/lowering mechanism 4, ideally a non-rotating pneumatic cylinder, to actuate the mechanism. The lock against rotation for position-oriented feeding is usually done via a profiled piston rod, but an external guide, for example, via a sliding bar guide with associated ring of the container upper part 2, would also be conceivable.

Instead of a pneumatic cylinder, a hydraulic, electric or electromagnetic cylinder can further be used. A pneumatic cylinder is advantageous because the compressed air is used for the tap system anyway and it also has a faster lifting/lowering speed with respect to the hydraulic. In addition, however, a manual operation, for example, via corresponding levers, is also conceivable.

The container upper part 2 (a type of "pressure bell"), which is open at the bottom and connected to the lifting/lowering mechanism 4, now is lowered down onto the container lower part 1 of the tap system that serves as a cover (or a bottom).

In addition, of course, an embodiment of the tap system would be conceivable in which, instead of the container upper part 2, the container lower part is connected to a lifting/lowering mechanism and the container upper part 2 is immovable.

Although both hands of the operator of the tap system are located outside the danger zone of the descending container upper part 2 due to the compulsory two-handed operation for activating the tapping program on the control unit 15, the tap system (to take into account very unlikely scenarios, for example, someone could "trip" forward with his hands while the container upper part 2 is lowered) may be provided with an emergency stop mechanism at the connection of the container upper part 2 with the piston rod of the lifting/lowering mechanism 4.

The emergency stop mechanism preferably consists of two contact elements 21, 22 (see FIG. 2), which in an inclined position—for example, triggered by a mechanical resistance during lowering—close an electrical circuit of the container upper part 2 connected to the piston rod of the lifting/lowering mechanism 4 via a ball joint suspension, which thus results in the immediate interruption of compressed air supply and thus the stoppage of the container upper part 2. Of course, the emergency stop mechanism could also work via a closed electrical circuit that is interrupted, or via a photoelectric switch, etc.

Shortly before placing the container upper part 2 on the container lower part 1, the container upper part 2 presses spring-loaded snap locks 23 to the side (see FIG. 3). Then the container upper part 2 is pressed by the lifting/lowering mechanism 4 with its (ideally concave) lower edge on an elastic sealing bead 16, which causes the springing back of the snap locks 23 in the basic position and thus a latching via the retaining strip 27 connected fixedly to the container upper part 2. The container upper part 2 is now fixedly and sealingly connected to the container lower part 1, jointly forming the now closed container 3 which seals the drinking vessels 7 hermetically from the outside environment.

By use of snap locks 23, in contrast to the mere pressing by the lifting/lowering mechanism 4, an additional, solid connection between container upper part 2 and container lower part 1 is formed. Thereby the entire dimensions of the frame thickness and the force of the lowering mechanism 4 can be much lower, because the lifting force of the container upper part 2 is not transferred to these components when pressurizing the container 3.

The walls of the container upper part 2 are either transparent (e.g., made of high-strength polycarbonate or safety glass), or made of metal with a window into the interior.

The latching of the snap locks 23 is preferably communicated to the control unit 15 via contacts and electrical circuits that provide the control unit 15 the information of the proper closure. In response thereto automatically controlled gas (most simply compressed air) flows via the supply line 11*b* into the container 3, whereby the set operating pressure is immediately reached (any overpressure escapes via a pressure relief valve 12). Along with this, the beverage supply is automatically started via an inlet 10. This happens, for example, via a solenoid valve at the entrance of the supply line 10 in an equalization tank 17. It may also be effected by solenoid valves in each individual filling line 14, which would individually enable the controlled shutdown, should the full power of the tap system not be desired or a possible drop from the filling lines 14 with too long pauses between the tapping processes be encountered.

The carbonated beverage now flows, the amount being controlled by the control unit, in the counter-pressure method via the equalization tank 17 through equal-length filling lines 14 into the drinking vessels 7. The drinking vessels 7 are preferably positioned exactly for the tapping process based on the connection of recess 18, the tray 5 and the holder 6. The thereby displaced air escapes through the pressure relief valve 12 which has a display 13.

After completion of the automatically running tapping process including a pressure compensation automatically adapted to the surrounding conditions (temperature, air pressure, etc.), the separation of container lower part 1 and container upper part 2 is effected by means of compressed air supply initiated by the control unit into small pneumatic cylinders 26, which, in each case push back against springs 25 connected to the snap locks 23. Then the container upper part 2 lifts and the tray 5 can be removed with the filled drinking vessels 7.

The tap system is now ready for the next working cycle which includes inserting the tray 5, lowering the container upper part 2, filling the drinking vessels 7, lifting the container upper part 2, and removing the tray 5.

In a particularly advantageous embodiment, the tap system can be rinsed fully automatically after its use. In this case, after activation of the cleaning program on the control unit 15, the container upper part 2 is lowered without inserted tray 5 onto the container lower part 1. Then, a hot water feed 8 is inserted, whereby hot water on the one hand flows through the container lower part 1 to a rinsing line 8*b* with nozzles at the end into the container 3 and this injected inside, and passes via another rinsing line 8*a* immediately behind the solenoid valve of the supply line 10 into the equalization tank 17 from there through the filling lines 14. All regions of the tap system where the carbonated beverage comes into contact with the air or causes contamination are thoroughly rinsed.

The rinsing lines 8*a*/8*b* and a drainage channel 9 of the tap system are preferably equipped with valves which are closed in the tapping operation (drainage channel 9 due to the overpressure) and are opened only for the cleaning process.

Since, in contrast to conventional tap systems, the entire hot water rinsing takes place in a hermetically sealed container 3, there is no escape of steam/moisture. In addition, no dirt can then reach the filling lines 14 when the tap system in not in use.

The rinse water preferably flows via the recess 18, which slopes slightly towards the middle, into the drainage channel 9. After switching off the control unit 15, the tap system is ready for the next use.

The tap system according to the invention is not limited in its execution to the above-mentioned preferred embodiments. Rather, a variety of design variations are conceivable, which make use of the solution shown even with fundamentally different type of execution.

The invention claimed is:

1. A tap system, comprising:
a container;
an equalization tank;
a plurality of filling lines arranged within the container which lead from the equalization tank to a plurality of drinking vessels;
a serving tray on which the plurality of drinking vessels are arranged; and
a gas supply line for pressurizing the container,
wherein a carbonated beverage is introduced through the plurality of filling lines into the plurality of drinking vessels while the container is pressurized.

2. The tap system as in claim 1, wherein the container comprises a container upper part and a container lower part, at least one of the container upper part and the container lower part being connected to a lifting/lowering mechanism.

3. The tap system as in claim 2, wherein the container upper part in a lowered position is fixedly connected to the container lower part via snap locks.

4. The tap system as in claim 3, wherein the snap locks are spring loaded and wherein engagement of the snap locks with the container upper part is communicated to an electronic control unit.

5. The tap system as in claim 4, wherein the snap locks are operatively connected to actuators and wherein the electronic control unit is configured to disengage the snap locks from the container upper part by activating the actuators.

6. The tap system as in claim 5, wherein the actuators are pneumatic cylinders.

7. The tap system as in claim 2,
further comprising an electrical circuit which is closed or interrupted if a defined inclination of the container upper part is exceeded while the container upper part is lowered onto the container lower part,
wherein the lifting/lowering mechanism is disabled if the electrical circuit is closed or interrupted.

8. The tap system as in claim 2, wherein compressed air flows through the gas supply line to the lifting/lowering mechanism.

9. The tap system as in claim 8, wherein the lifting/lowering mechanism comprises a non-rotating pneumatic cylinder and wherein compressed air flows through the gas supply line to the non-rotating pneumatic cylinder.

10. The tap system as in claim 1, wherein the serving tray has an inner retaining brim which is configured to accept a drinking vessel holder.

11. The tap system as in claim 10, wherein the serving tray and the drinking vessel holder each have a matching shape feature that secures an orientation of the drinking vessel holder with respect to the serving tray.

12. The tap system as in claim 1,
further comprising at least one of
a solenoid valve arranged within a supply line upstream of the equalization tank and
a plurality of solenoid valves arranged within the plurality of filling lines downstream of the equalization tank,
wherein introducing the carbonated beverage into the plurality of drinking vessels is controlled by actuating the solenoid valve or the plurality of solenoid valves.

13. The tap system as in claim 1, further comprising:
an electronic control unit;
rinsing lines in flow communication with a hot water feed; and
a drainage channel,
wherein the electronic control unit is programmed to execute a cleaning program during which hot water is sprayed through the rinsing lines into the container and exits the container through the drainage channel.

14. A tap system, comprising:
a container formed by a container upper part and a container lower part which are movable relative to each other;
an equalization tank; and
a plurality of filling lines arranged within the container upper part which lead from the equalization tank to a plurality of drinking vessels arranged inside the container,
wherein a carbonated beverage is introduced from the equalization tank through the plurality of filling lines into the plurality of drinking vessels while the container is pressurized and the container upper part is sealingly connected to the container lower part by a snap lock.

15. The tap system as in claim 14, wherein the snap lock is spring loaded and wherein engagement of the snap lock with the container upper part is communicated to an electronic control unit.

16. The tap system as in claim 14, further comprising:

an electronic control unit;

a lifting/lowering mechanism operatively connected to the electronic control unit; and two contact plates arranged at an articulated connection of the container upper part with the lifting/lowering mechanism, the contact plates being electrically connected with the electronic control unit, wherein the electronic control unit comprises an emergency stop function.

17. The tap system as in claim 14, further comprising:

a plurality of rinsing lines;

a drainage channel; and an electronic control unit, wherein the electronic control unit is configured to execute a cleaning program and wherein hot water is injected into the container through the plurality of rinsing lines and exits the container through the drainage channel during execution of the cleaning program.

* * * * *